US008281676B1

(12) United States Patent
Perez et al.

(10) Patent No.: US 8,281,676 B1
(45) Date of Patent: Oct. 9, 2012

(54) TRANSMISSION UTILIZING HYPOCYCLOID MOTION

(76) Inventors: Raul Jose Perez, Downey, CA (US); Raul Evan Perez, Downey, CA (US)

( * ) Notice: Subject to any disclaimer, the term of this patent is extended or adjusted under 35 U.S.C. 154(b) by 1142 days.

(21) Appl. No.: 12/145,374

(22) Filed: Jun. 24, 2008

Related U.S. Application Data

(60) Provisional application No. 60/946,339, filed on Jun. 26, 2007.

(51) Int. Cl.

| | |
|---|---|
| ***F16H 21/12*** | (2006.01) |
| ***F16H 21/48*** | (2006.01) |
| ***F16H 25/08*** | (2006.01) |
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F16N 13/20*** | (2006.01) |

(52) U.S. Cl. ..... 74/63; 418/61.1

(58) Field of Classification Search ..... 74/63–69, 74/595, 596; 280/214–216; 123/52.2–52.6, 123/54.3; 418/54, 61.1–61.3

See application file for complete search history.

(56) References Cited

U.S. PATENT DOCUMENTS

| | | | | |
|---|---|---|---|---|
| 3,930,766 | A * | 1/1976 | Swedberg | 418/61.3 |
| 4,249,750 | A | 2/1981 | Kantner | |
| 4,537,094 | A * | 8/1985 | Bursa et al. | 475/168 |
| 4,542,664 | A * | 9/1985 | Sladek et al. | 475/168 |
| 4,585,404 | A * | 4/1986 | Barata | 418/61.1 |
| 4,684,143 | A | 8/1987 | Sato | |
| 5,387,000 | A | 2/1995 | Sato | |
| 5,397,283 | A * | 3/1995 | Pratolongo | 475/254 |
| 5,495,926 | A | 3/1996 | Rheingold | |
| 5,938,224 | A | 8/1999 | Brackett | |
| 6,837,141 | B1 | 1/2005 | Edelson | |
| 6,904,877 | B2 | 6/2005 | Stokes | |
| 2004/0052670 | A1 * | 3/2004 | Dong | 418/61.3 |

* cited by examiner

*Primary Examiner* — Justin Krause

(74) *Attorney, Agent, or Firm* — QuickPatents, Inc.; Kevin Prince

(57) ABSTRACT

A transmission system for transmitting a rotary motion input to a rotary motion output utilizing hypocycloid motion multiplication is disclosed. The system comprises an input mechanism, at least one hydraulic transmission means, an output mechanism and an output bladder linkage. The input mechanism includes a plurality of rollers that each capture at least one arcuate linkage against an inside surface of a cylindrical hub, causing the linkage to rotate as the roller traverses thereacross and compress one of a plurality of input bladders. The compressed input bladders cause an output bladder to expand to drive the output mechanism in reciprocal linear motion, which the output mechanism converts to rotational motion at the rotary motion output. The output mechanism can be located proximate to, or distal from, the input mechanism.

13 Claims, 11 Drawing Sheets

TRANSMISSION UTILIZING HYPOCYCLOID MOTION

CROSS-REFERENCE TO RELATED APPLICATIONS

This application claims the benefit of U.S. Provisional Patent Application 60/946,339, filed on Jun. 26, 2007, and incorporated herein by reference.

STATEMENT REGARDING FEDERALLY SPONSORED RESEARCH AND DEVELOPMENT

Not Applicable.

FIELD OF THE INVENTION

The present invention relates, in general, to apparatuses for converting one form of motion into another, and in particular, to an apparatus for converting rotating motion to reciprocating linear motion utilizing hypocycloid motion.

BACKGROUND

A typical automotive engine creates torque and uses it to spin the crankshaft. This torque is created when a force is applied for a distance. The combustion of gas in a cylinder creates pressure against the piston, which, in turn, creates a force on the piston to push it in a linear motion. The force is transmitted from the piston to a connecting rod, and from the connecting rod into a crankshaft. The connecting rod attaches to the crankshaft some distance from the center of the shaft. The horizontal distance changes as the crankshaft spins, so the torque also changes, since torque equals force multiplied by distance (only in the horizontal component). Only the horizontal distance is important in determining the torque in this type of engine, since when the piston is at the top of its stroke the connecting rod is oriented straight at the center of the crankshaft, and no torque is generated in this position since only the force that acts on the lever in a direction perpendicular to the lever generates torque, and the distance in this point is zero.

Another interesting fact about this type of commonly used linear to rotary converter mechanism is that the displacement of the piston is equal to the diameter of the circular movement, but the torque captured by this type of converter is calculated as a maximum of the radius of this circular movement multiplied by the force applied thereto. This identifies a 50% inefficiency in such systems.

In geometry, a hypocycloid is a special plane curve generated by the trace of a fixed point on a small circle that rolls within a larger circle. It is comparable to a cycloid but instead of the circle rolling along a line, it rolls within a circle. If the smaller circle has radius r, and the larger circle has radius R=kr, then the parametric equations for the curve can be given by:

$$x(\theta) = r(k-1)\left(\cos\theta + \frac{\cos((k-1)\theta)}{k-1}\right),$$

$$y(\theta) = r(k-1)\left(\sin\theta - \frac{\sin((k-1)\theta)}{k-1}\right).$$

If k is an integer, then the curve is closed, and has k cusps—that is, sharp corners where the curve is not differentiable. In the case where a/b=2, the trace of the moving point is a straight line. The arc length and area are therefore given by:

$$s_x = 8b(n-1) = \frac{8a(n-1)}{n}$$

$$A_x = \frac{(n-1)(n-2)}{n^2}\pi a^2.$$

A 2-cusped hypocycloid is a line segment (Steinhaus 1999, p. 145; Kanas 2003), as can be seen by setting a=2b in equations therefore noting that the equations simplify to:

$$x = a\sin\theta$$

$$y = 0.$$

The straight line is the only curve for which its tangent coincides with the curve itself. When the center of inversion is not on the line, the inverse of the line is a circle.

If we have a rectangular coordinate system, the horizontal x-axis and the vertical y-axis (the ordinate). Given two points A and B, a straight line through these points makes the shortest path between A and B. The angle of the line with a coordinate axis is constant, and also the derivative of a straight line is constant.

A common mechanism used to convert rotational motion to linear motion is a wheel and rail, such as with railed vehicles or any vehicle driven on a substantially flat surface. If the wheel and road are ideally hard, and the road is level, and disregarding friction losses, the effort to move a load W parallel to the road is zero for any load W. A ball or roller bearing can also be considered in this category of mechanisms, where the road has been "rolled up" into a closed circle. In such a system, the load does not move in the direction of the gravity vector, so the velocity ratio is zero while the advantage is infinite, the limit of the product of these being unity (again, disregarding frictional losses).

The lever or block and tackle is one of the most familiar machines, and its family of related machines is widespread and varied. The lever consists of a lever proper and a fulcrum, to which are applied the load W and the effort F. For an ideal lever 1, when the effort F moves a distance x vertically, the load W moves a distance y=−(b/a)x vertically as well, where a is the distance along the lever between the fulcrum and the force applied to the lever, and where b is the distance along the lever between the fulcrum and the load W. The negative sign indicates that the movements are in opposite directions. For the lever to remain in equilibrium, the moments of the forces acting upon it, with respect to any axis, must be zero. Taking the axis through the fulcrum (which eliminates the reaction force R=F+W) results in Fa−Wb=0, or W=(a/b)F.

The principle of virtual work, very often the easiest way to analyze a machine is, is given by the product of the advantage a/b and the velocity ratio b/a, which is indeed unity (in absolute value). If we multiply the two equation we have obtained by considering the movement and the forces separately, we find Wy=−(b/a)(a/b)Fx, or Wy+Fx=0. If we define the product of a force and a displacement in the direction of the force to be the work done by the force, we conclude that the total work done by all of the external forces in a (small) displacement of a such a machine is zero. Herein, this is what we refer to by a "balanced system" in the subsequent explanation. We see both sides of the conversion of movements, rotary to linear and linear back to rotary, using this same principle.

Analysis of Crank and slider or piston and crank (Rotary to Reciprocating Linear Motion Converter)

A famous mechanism is the crank and slider, which converts reciprocating motion into rotary motion. It was patented by James Pickard in 1780, prompting Watt to devise the sun and planet gear as an alternative. Watt's first rotary engines used the parallel motion and the sun and planet gear. We define x in this type of machine as the displacement of the slider from the position of Front Dead Centre (FDC). The angle the crank has rotated from FDC is $\theta$, and the inclination of the connecting rod is $\phi$. a is given by the length of the crank. The relation between the angles is given by: $a \sin \phi = r \sin \theta$, and $x = a(1-\cos \phi) + r(1-\cos \theta)$.

The perimeter of a circle is given by $\Pi$ multiplied by Diameter. Thus, the displacement of the slider necessary to generate one rotation of the crank is equal to 2 times the diameter of the circle. Therefore the distance traveled by a point in the circumference is greater than the distance traveled by a point in the slider. This difference is represented by $\Pi/2 = 1.57$ (approximately).

When applying forces to this system we can observe that in the input of linear motion, force would have to be applied to a distance of a Diameter twice (or reciprocally) to generate a complete circular motion turn of the crank. But at the output, which is rotational motion, torque is calculated by multiplying the same force applied at a point C by the radius of the circumference as well as passing twice through Y=0 which generates Torque=0. As a conclusion we can see that this system produces a 50% loss of force when converting from linear to rotary motion.

What is needed, therefore, is a motion conversion system that maintains a balanced system between input and output distances, applied forces and motions. This can be accomplished by converting a rotary motion input into a hypocycloid motion having only two cusps (straight line curve). In such a needed device, one rotation of a rotary input shaft would generate at least 32 reciprocal linear cycles internally, which would be converted into at least four rotations of a rotary output shaft while maintaining the same torque characteristics between input and output. Such a needed system would be relatively simple and contain relatively few parts. Further, loses due to friction would be minimal. The present invention accomplishes these objectives.

SUMMARY OF THE INVENTION

The present invention is a transmission system for efficiently transmitting a rotary motion input to a rotary motion output. The system comprises an input mechanism, at least one hydraulic transmission means, an output mechanism and an output bladder linkage. The input mechanism comprises a rotary input cam rotationally fixed to at least one, and preferably four or five, rollers. A substantially cylindrical hub is further included for constraining a plurality of arcuate linkages therein, preferably numbering eight or ten, each of which are pivotally fixed at each end thereof to an adjacent arcuate linkage and a first end of a linear displacement linkage. Each of the at least one rollers captures at least one arcuate linkage against an inside surface of the cylindrical hub, causing the linkage to rotate as the roller traverses thereacross. Each linear displacement linkage is pivotally is fixed at a second end thereof to a plunger means. As such, the input mechanism, utilizing hypocycloid motion, multiplies one rotation of the input cam into four or five reciprocal cycles of each plunger means, translating into a 4:1 or 5:1 ratio.

The hydraulic transmission means each include a plurality of input bladders that each cooperate with one of the plunger means and is in fluid communication with an output bladder. Each hydraulic transmission means is substantially filled with a generally non-compressible fluid that is in fluid communication with the output bladder thereof through a hydraulic conduit.

Each plunger means is preferably a pair of horizontal sliding members each pivotally fixed at one end to the second end of one of the plurality of linear displacement linkages. Further, the cylindrical hub preferably includes a plurality of bladder cavities each for containing one of the input bladders. As such, each pair of horizontal sliding members may be forced against the cylindrical hub within each bladder cavity to compress the input bladder. Every other odd plunger means thereby compresses every other odd input bladder, which is all of the input bladders of one of the hydraulic transmission means. Meanwhile, every other even plunger means expands, allowing every other even input bladder to expand, which is all of the input bladders of the other of the hydraulic transmission means. The output bladder of the one hydraulic transmission means drives the output bladder linkage as well as compressing the output bladder of the other hydraulic transmission means, thereby expanding the output bladders thereof.

One preferred output mechanism comprises a substantially hollow enclosure that captures a generally circular outer ring that itself captures a substantially circular middle ring. The middle ring has a circular opening therein that is offset from the center of the middle ring. The circular opening captures an inner ring that has an aperture proximate to a peripheral edge thereof. The aperture rotationally captures a crankshaft at one end, a second end of which is rotationally fixed to a center aperture of the enclosure and forms the rotary motion output.

An output bladder linkage cooperates with the output bladder of each hydraulic transmission means for conveying synchronized reciprocal motion of each output bladder to the outer ring of the output mechanism. In one preferred embodiment, for every one rotation of the input cam, four cycles of reciprocal motion of the output bladder linkage causes the outer ring to reciprocate four times. Preferably the output bladder linkage comprises at least one output bladder-engaging plunger that includes two members each pivotally joined at one end thereof to a first end of a lateral displacement member. The lateral displacement member is captured within a channel of an output bladder linkage enclosure. A second end of the lateral displacement member is pivotally fixed to the outer ring of the output mechanism, preferably with a pin. As such, reciprocal motion of the output bladder is mechanically transferred to the lateral displacement member, the pin, and to the outer ring of the output mechanism.

In a second preferred embodiment of the output mechanism, the lateral displacement member includes a plurality of output posts that each engage an elongated output block slot in an output block. The output block further includes a circular output block aperture therein that rotatably receives a block ring fixed to the rotary motion output. As such, with each output post moving in synchronized linear reciprocal motion, the output block is driven in orbital motion around the rotary motion output and the off-center block ring rotates within the output block aperture to drive the rotary motion output.

In use, when the rotary motion input is applied to the rotary input cam of the input mechanism, each of the at least one rollers in turn depresses each linear displacement linkage. The plurality of arcuate linkages each lift each linear displacement linkage once the roller has passed thereby. Each linear displacement linkage actuates on of the plunger means to compress one of the input bladders, causing the output bladders to assume a non-compressed, expanded position. Each output bladder is coupled through the output bladder linkage to reciprocate, in the first preferred embodiment, the outer ring of the output mechanism within the enclosure, and in the second preferred embodiment, the output block. In the first preferred embodiment, the inner ring is forced to follow an inverse hypocycloid motion with two cusps to rotate the crankshaft around the center aperture of the enclosure to produce the rotary motion output. In the second preferred embodiment, the output block is driven in orbital motion around the rotary motion output and the block ring rotates within the output block aperture to drive the rotary motion output.

At the first stage, or input mechanism, one full turn convert internally into four hypocycloids reciprocal movements per linear displacement linkage connected to two arcuate linkages. Thus a total displacement of 8 radii of linear displacements is produced is internally at the hydraulic transmission means. At this stage the system is slightly comparable to the movements of an eight cylinder engine, except that a conventional eight cylinder engine generates only one reciprocal linear cycle per cylinder with each rotation. Conventional systems produce a total of eight reciprocal linear cycles per rotation. My design, however, in the input mechanism generates four reciprocal linear cycles per "cylinder" (linear displacement linkage) with each rotation, or a total of thirty-two reciprocal linear cycles per rotation.

In comparison to the block and tackle machine of the prior art, my device acts like four unidirectional variable fulcrums, due to the fact that instead of the traditional way of applying the force at a distance from the fulcrum to produce movement into the machine, I apply the force to the fulcrum itself and the direction of this force is always at 90 degrees to the load, making possible to calculate that work done equals zero, except for frictional losses. As such, this part of the present device is very efficient indeed.

The input mechanism alone could also be used as a pump to convert one rotational motion to 32 reciprocal linear cycles or more, depending on the number of linear displacement linkages used (preferably eight or ten) and type of hypocycloid used.

The present invention is a motion conversion system that maintains a balanced system between input and output distances, applied forces and motions. This is accomplished by converting a rotary motion input into a hypocycloid motion having only two cusps (straight line curve). In the present device, one rotation of the rotary input generates at least 32 reciprocal linear cycles internally, which are converted into at least four rotations of the rotary output while maintaining the same torque characteristics between input and output. The present invention is relatively simple and contains relatively few parts. Further, loses due to friction are minimal. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
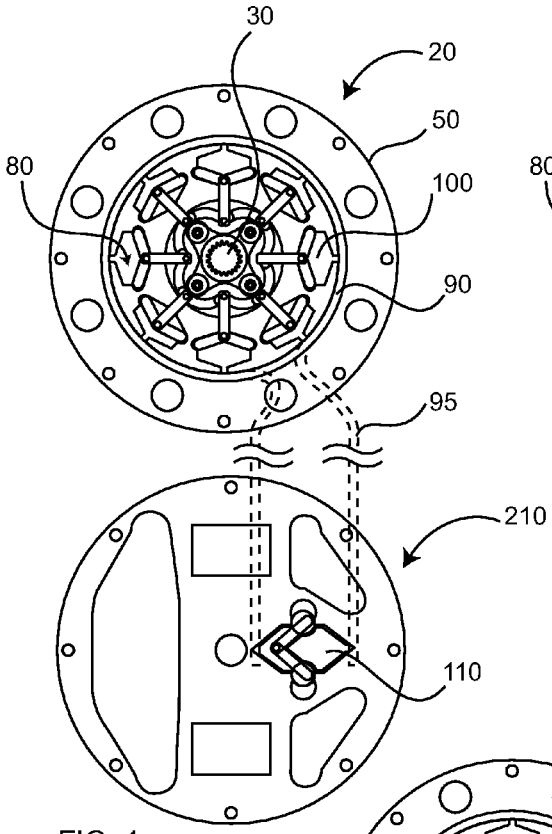
FIG. 1 is a side elevational view of an input mechanism, hydraulic transmission means, and a portion of an output bladder linkage of the invention.
Figure 12:
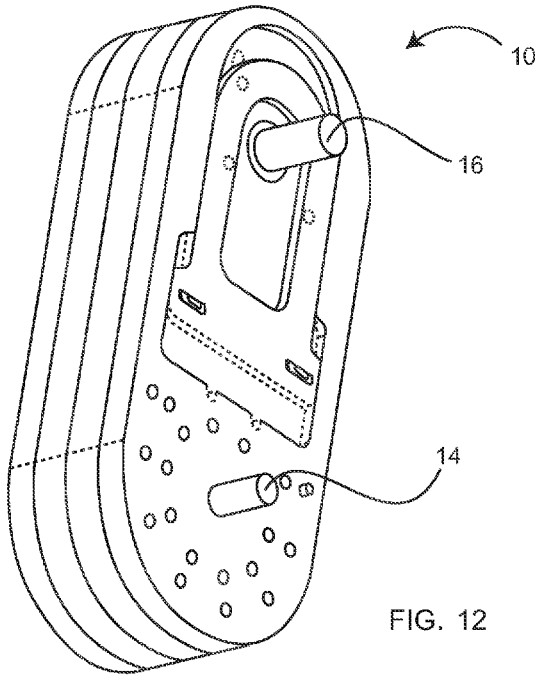
FIG. 12 is a front perspective view of the second preferred embodiment of the invention.
Figure 13A:
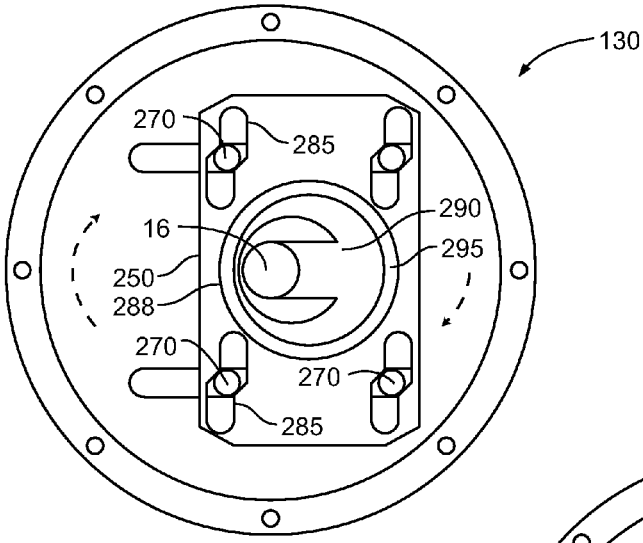
FIG. 13A is a side elevational view of the second preferred embodiment of the output mechanism in a right-most position, the rotary motion output at an approximately 3:00 position.
Figure 13B:
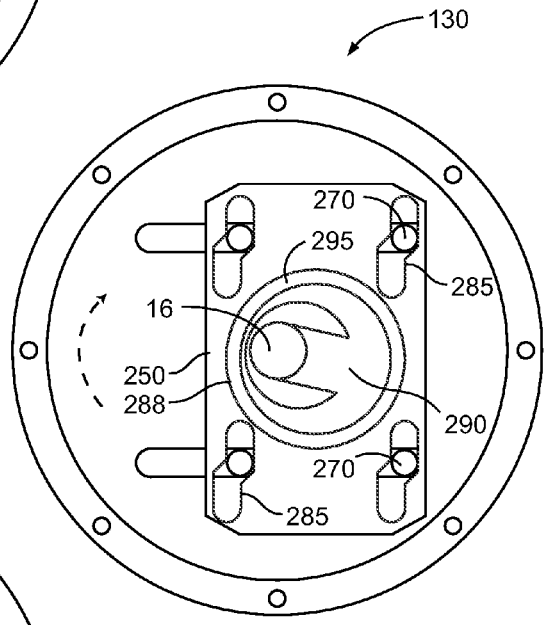
FIG. 13B is a side elevational view of the second preferred embodiment of the output mechanism near the right-most position, the rotary motion output at an approximately 3:30 position.
Figure 13C:
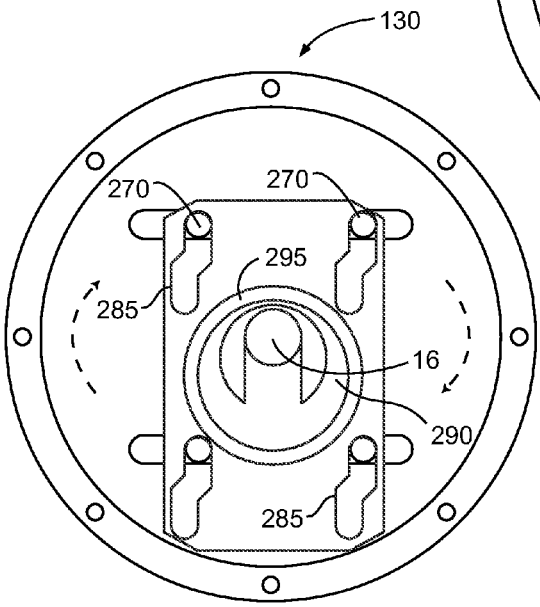
FIG. 13C is a side elevational view of the second preferred embodiment of the output mechanism in a bottom-most position, the rotary motion output at an approximately 6:00 position.
Figure 13D:
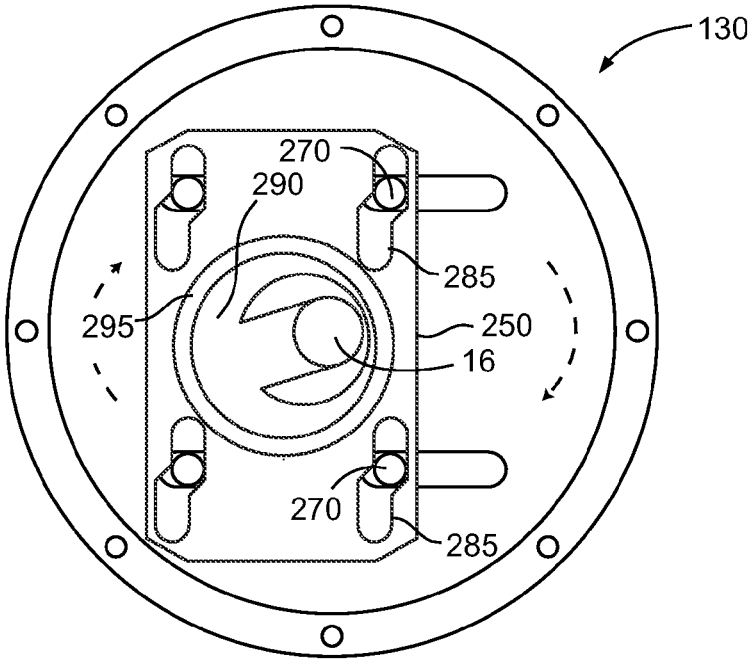
FIG. 13D is a side elevational view of the second preferred embodiment of the output mechanism near a left-most position, the rotary motion output at an approximately 8:30 position.
Figure 13E:
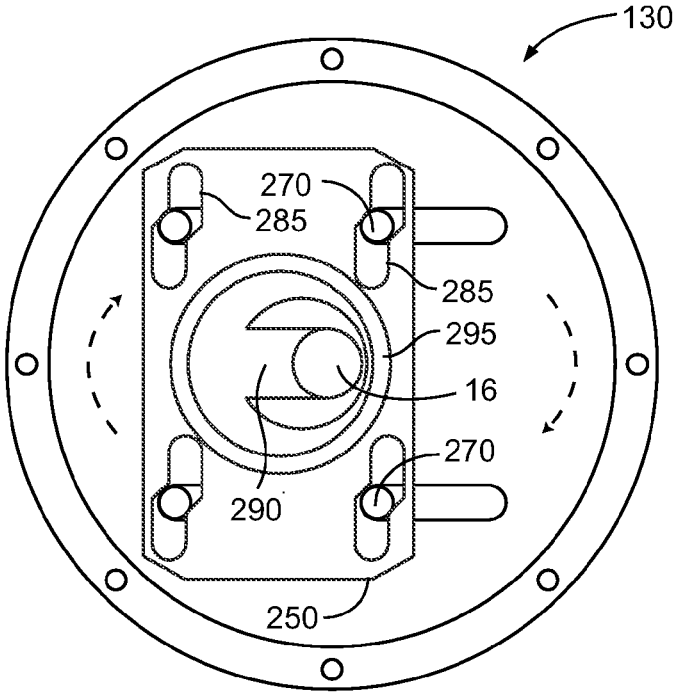
FIG. 13E is a side elevational view of the second preferred embodiment of the output mechanism in a left-most position, the rotary motion output at an approximately 9:00 position.

FIGS. 1 and 12 illustrate a transmission system 10 for transmitting a rotary motion input 14 to a rotary motion output 16, such as may be necessary in a vehicle, for example, to convey rotary motion of an engine or a pair of bicycle pedals (not shown) into rotary motion of a wheel, drive train, or the like (not shown).

The system 10 comprises an input mechanism 20, at least one hydraulic transmission means 90, an output mechanism 130 and an output bladder linkage 210. The input mechanism 20, output mechanism 130 and the output bladder linkage 210 are preferably made from rigid metal components, although strong, rigid plastic or ceramic components may also suffice. The hydraulic transmission means 90 is preferably made at least partially from a non-rigid material capable of being repeatedly compressed and expanded without rupturing.

Figure 5A:
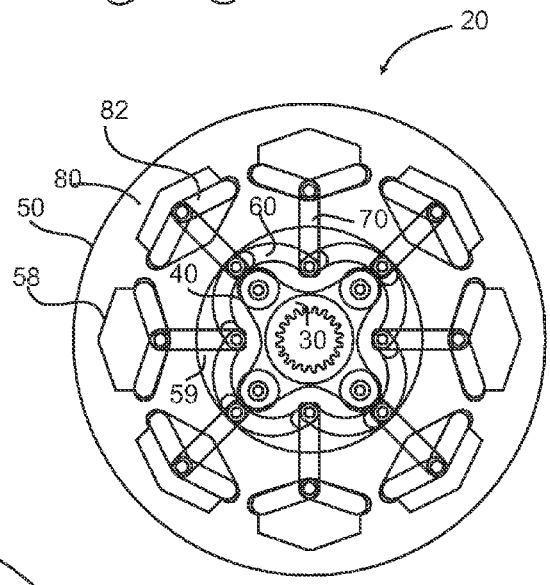
FIG. 5A is a side elevational view of the input mechanism of the invention, illustrating every other of eight plunger means in a compressed position.
Figure 5B:
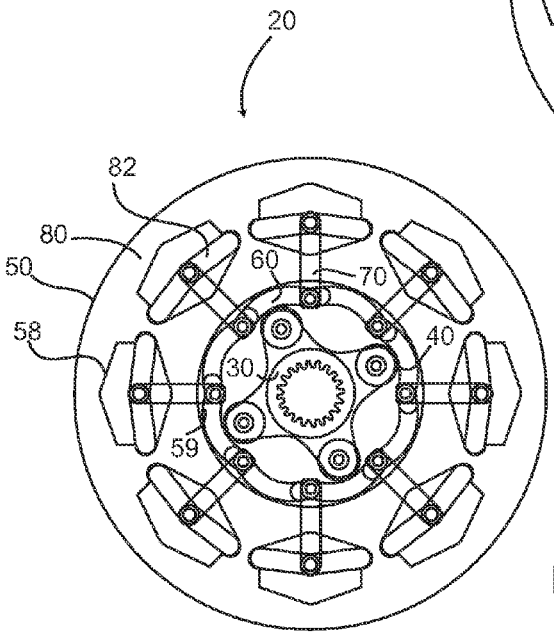
FIG. 5B is a side elevational view of the input mechanism of the invention, illustrating every other plunger means in between the compressed position and a non-compressed position.
Figure 5C:
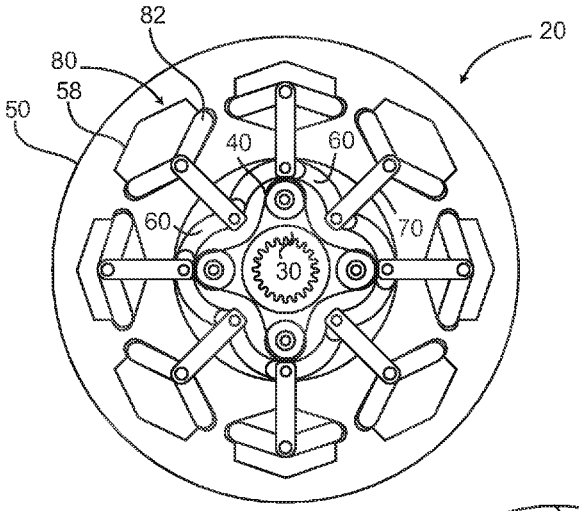
FIG. 5C is a side elevational view of the input mechanism of the invention, illustrating every other plunger means in the non-compressed position.

As best shown in FIGS. 4 and 5A-5C, the input mechanism 20 comprises a rotary input cam 30 rotationally fixed to at least one, and preferably four or five, rollers 40 proximate to a periphery 35 of the input cam 30. A substantially cylindrical hub 50 is further included for constraining a plurality of arcuate linkages 60 therein, preferably numbering eight or ten, each of which are pivotally fixed at each end 62 thereof to an adjacent arcuate linkage 60 and a first end 74 of a linear displacement linkage 70. Each of the at least one rollers 40 captures at least one arcuate linkage 60 against the inside surface 54 of the cylindrical hub 50, causing the linkage 60 to rotate as the roller 40 traverses thereacross. Each linear displacement linkage 70 is pivotally fixed at a second end 76 thereof to a plunger means 80. FIGS. 5A-5C illustrate the input mechanism 20 as the gear 30 is rotated, illustrating each plunger means 80 alternately assuming a compressed or non-compressed position in turn.

As such, the input mechanism 20 in one preferred embodiment (FIGS. 1-6C), utilizing hypocycloid motion, multiplies one rotation of the input cam 30 into four reciprocal cycles of each plunger means 80, translating into a 4:1 ratio. In the alternate preferred embodiment (FIG. 10), the input mechanism 20 multiples one rotation of the input cam 30 into five reciprocal cycles of each plunger means 80, translating into a 5:1 ratio.

Figure 2:
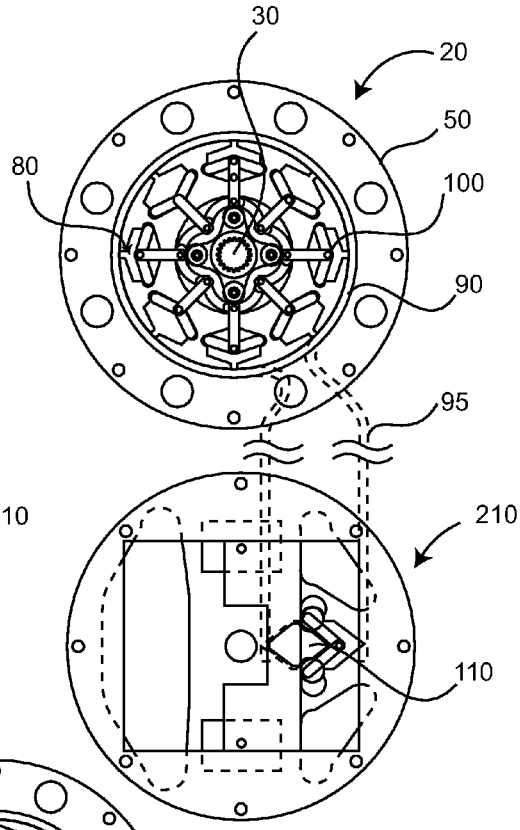
FIG. 2 is a side elevational view of an input mechanism, hydraulic transmission means, and the output bladder linkage of the invention, shown with the input mechanism rotated and with the hydraulic transmissions means oppositely phased with respect to FIG. 1.
Figure 3:
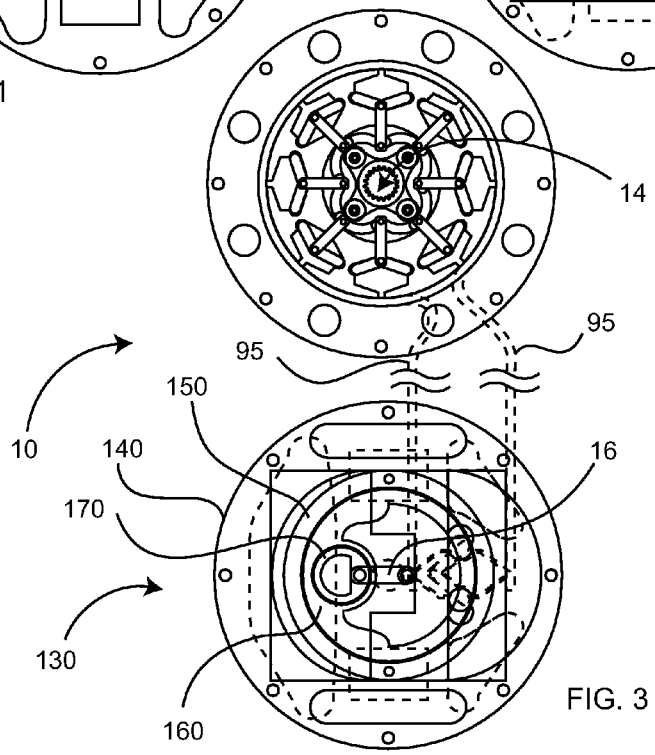
FIG. 3 is a side elevational view of an input mechanism, hydraulic transmission means, an output bladder linkage, and an output mechanism of the invention.
Figure 4:
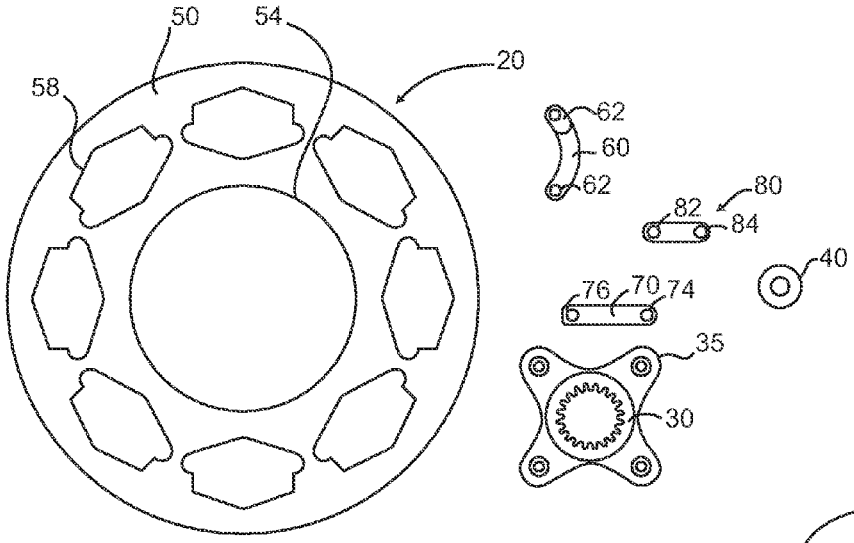
FIG. 4 is an exploded view of components of the input mechanism of the invention, is illustrating various components thereof.
Figure 6A:
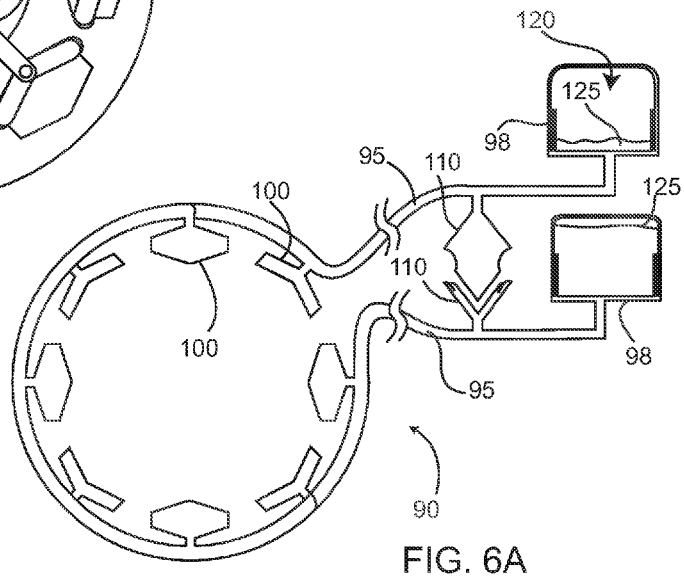
FIG. 6A is a side elevational view of a pair of hydraulic transmission means, illustrating every other of eight input bladders in a compressed position and an output bladder in a non-compressed position.
Figure 6B:
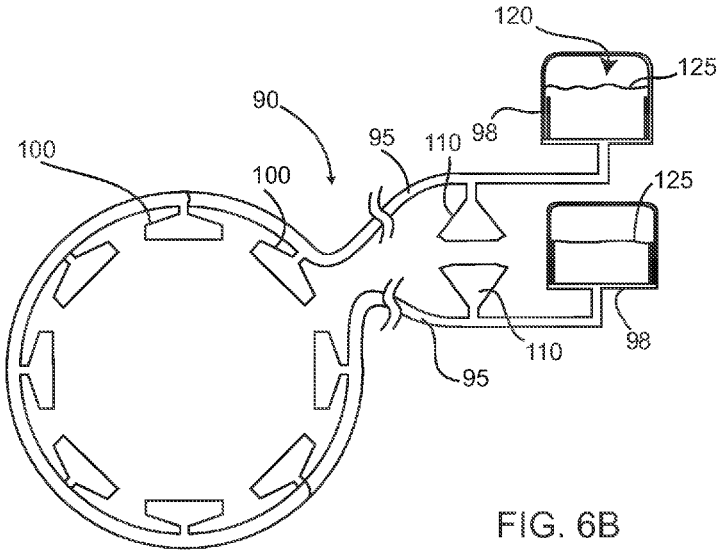
FIG. 6B is a side elevational view of the pair of hydraulic transmission means, illustrating every other input bladder and the output bladder in between the compressed position and a non-compressed position.
Figure 6C:
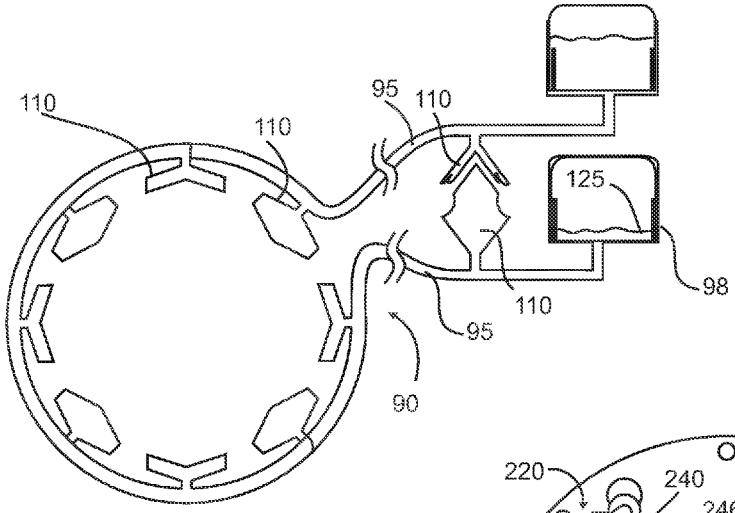
FIG. 6C is a side elevational view of the pair of hydraulic transmission means, illustrating every other input bladder in the non-compressed position and the output bladder in a compressed position.

The at least one, and preferably two, hydraulic transmission means 90 each include a plurality of input bladders 100 (FIGS. 6A-6C). Each input bladder 100 cooperates with one of the plunger means 80 of the input mechanism 20 and is in fluid communication with an output bladder 110. Each hydraulic transmission means 90 is substantially filled with a generally non-compressible fluid 120, such as water or hydraulic fluid 125. Each input bladder 100 of each of the hydraulic transmission means 90 are in fluid communication with the output bladder 110 thereof through a hydraulic conduit 95 (FIGS. 1-3). A fluid pressure adjustment means 98, such as a manual pressure adjustment mechanism or a spring-loaded bladder, for example, may be included to provide positive pressure within each hydraulic transmission means 90 (FIGS. 6A-6C). The sum of the volumes of each input bladder 100 of each transmission means 90 is equal to the volume of the output bladder 110.

Figure 10:
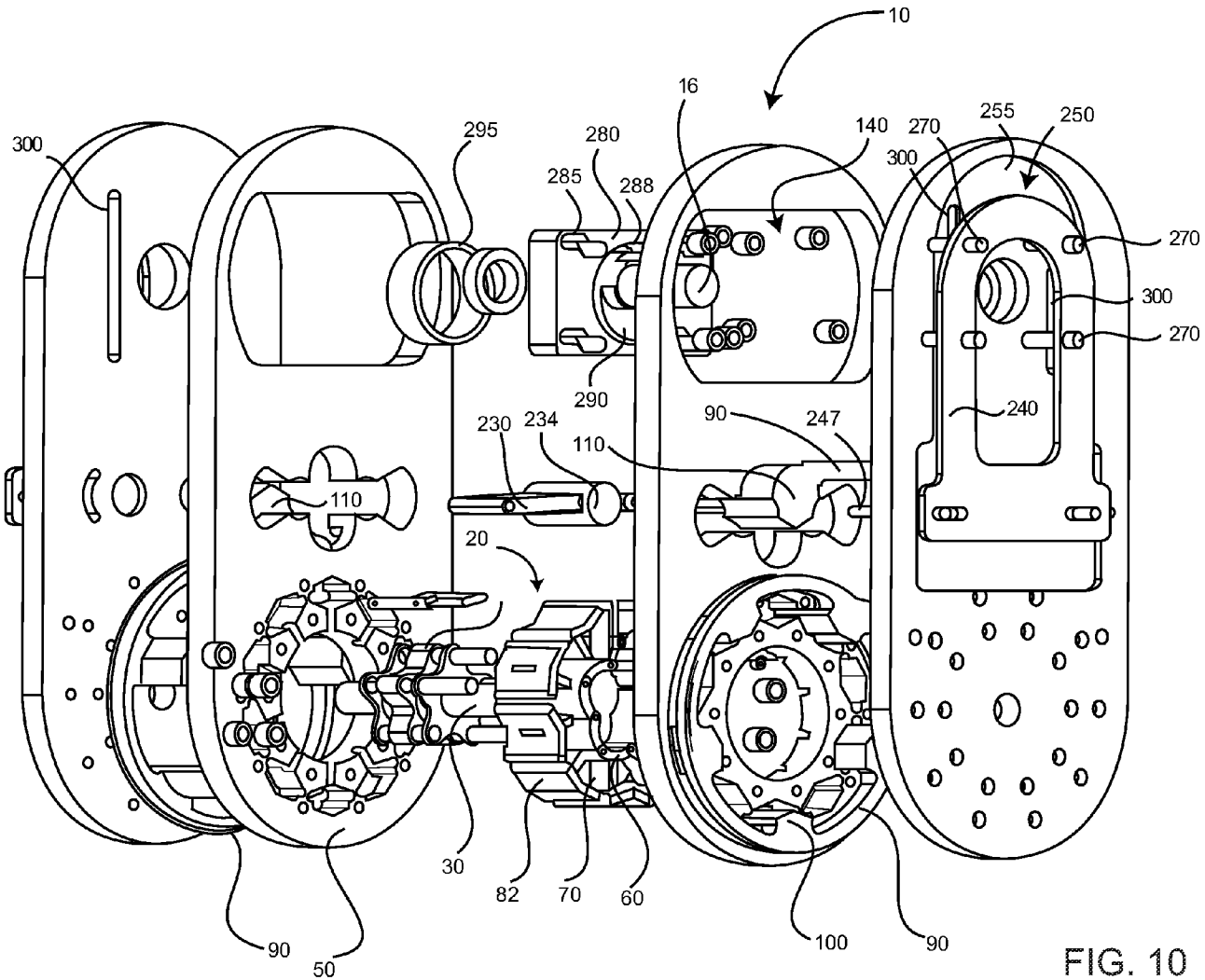
FIG. 10 is an exploded perspective view of a second preferred embodiment of the invention.
Figure 11:
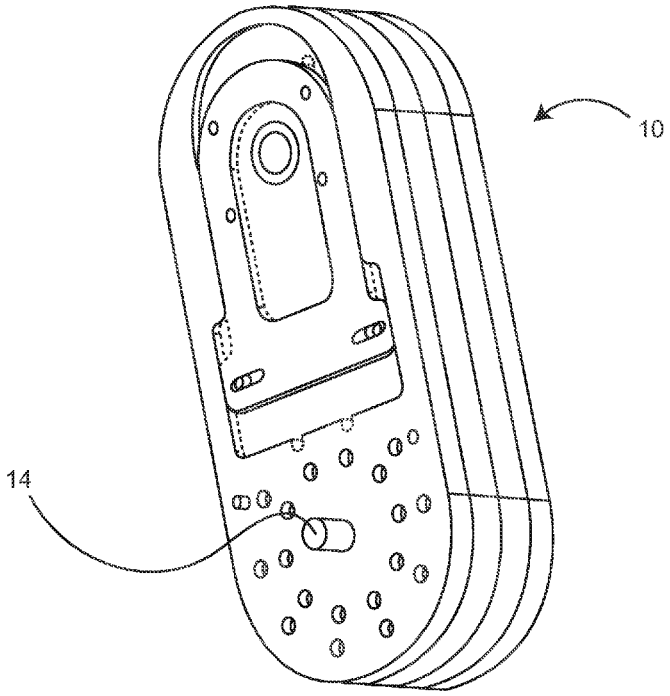
FIG. 11 is a rear perspective view of the second preferred embodiment of the invention.

The input mechanism 20, each hydraulic transmission means 90, output bladder linkage 210 and output mechanism 130 may each be aligned coaxially such that the transmission system 10 may be contained within a single assembly (FIGS. 10-12). Alternately, the input mechanism 20 and the input bladders 100 of each hydraulic transmission means 90 is may be located apart from the output bladder linkage 210 and the output mechanism 130, each hydraulic conduit 95 connecting each assembly (FIGS. 1-3).

Each plunger means 80 is preferably a pair of horizontal sliding members 82 each pivotally fixed at one end 84 to the second end 76 of one of the plurality of linear displacement linkages 70. Further, the cylindrical hub 50 preferably includes a plurality of bladder cavities 58 each for containing one of the input bladders 100. As such, each pair of horizontal sliding members 82 may be forced against the cylindrical hub 50 within each bladder cavity 58 to compress the input bladder 100. In the embodiment illustrated in the figures, every other odd plunger means 80 compresses every other odd input bladder 100, which is all of the input bladders 100 of one of the hydraulic transmission means 90. Meanwhile, every other even plunger means 80 expands, allowing every other even input bladder 100 to expand, which is all of the input bladders 100 of the other of the hydraulic transmission means 90. The output bladder 100 of the one hydraulic transmission means 90 drives the output bladder linkage 210 as well as compressing the output bladder 110 of the other hydraulic transmission means 90, thereby expanding the output bladders 100 thereof.

Figure 8:
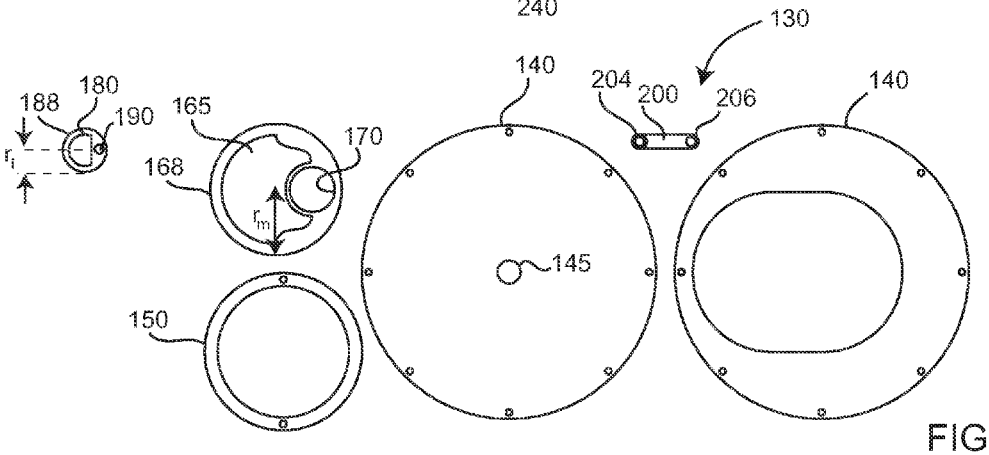
FIG. 8 is an exploded view of the output mechanism, illustrating various components thereof.
Figure 9A:
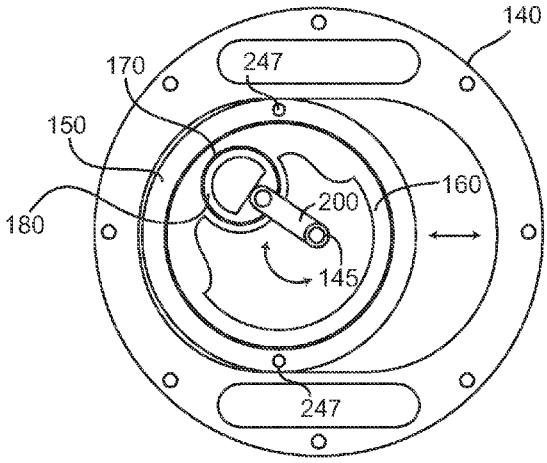
FIG. 9A is a side elevational view of the output mechanism in a left-most position, the rotary motion output at an approximately 10:00 position.
Figure 9B:
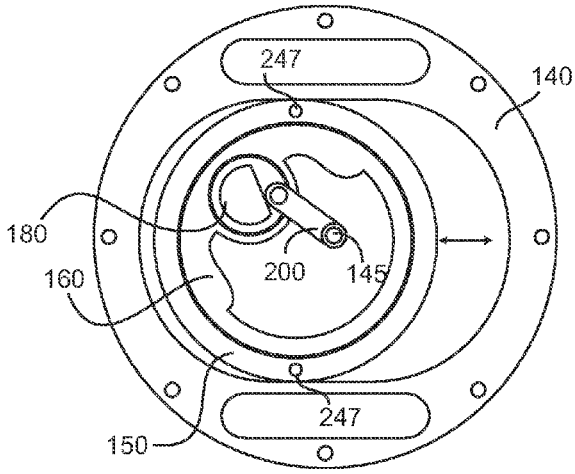
FIG. 9B is a side elevational view of the output mechanism near the left-most position, the rotary motion output at an approximately 10:30 position.
Figure 9C:
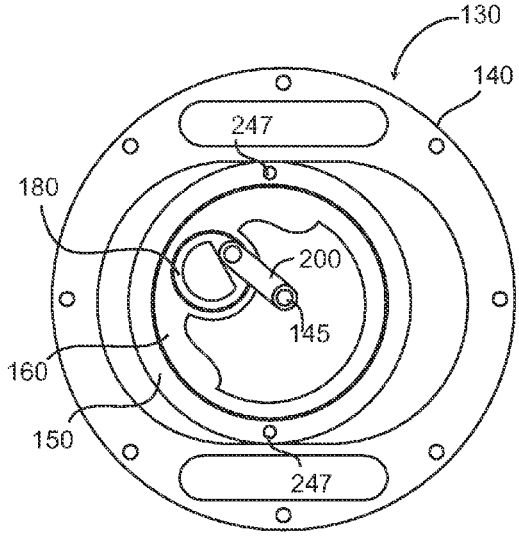
FIG. 9C is a side elevational view of the output mechanism between the left-most position and a central position, the rotary motion output at an approximately 10:45 position.
Figure 9D:
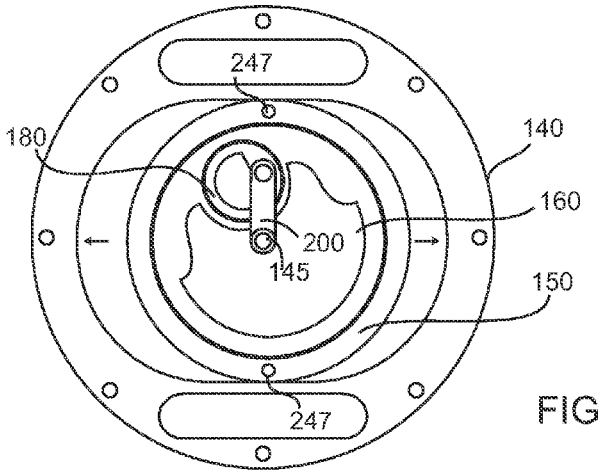
FIG. 9D is a side elevational view of the output mechanism near the central position, the rotary motion output at an approximately 12:00 position.
Figure 9E:
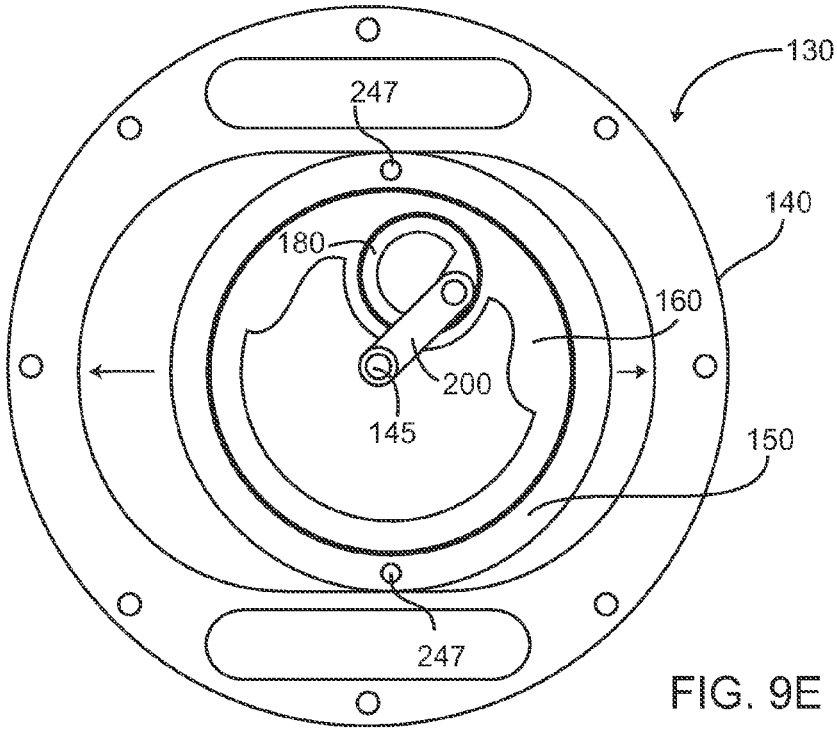
FIG. 9E is a side elevational view of the output mechanism between the central position and a right-most position, the rotary motion output at an approximately 1:30 position.
Figure 9F:
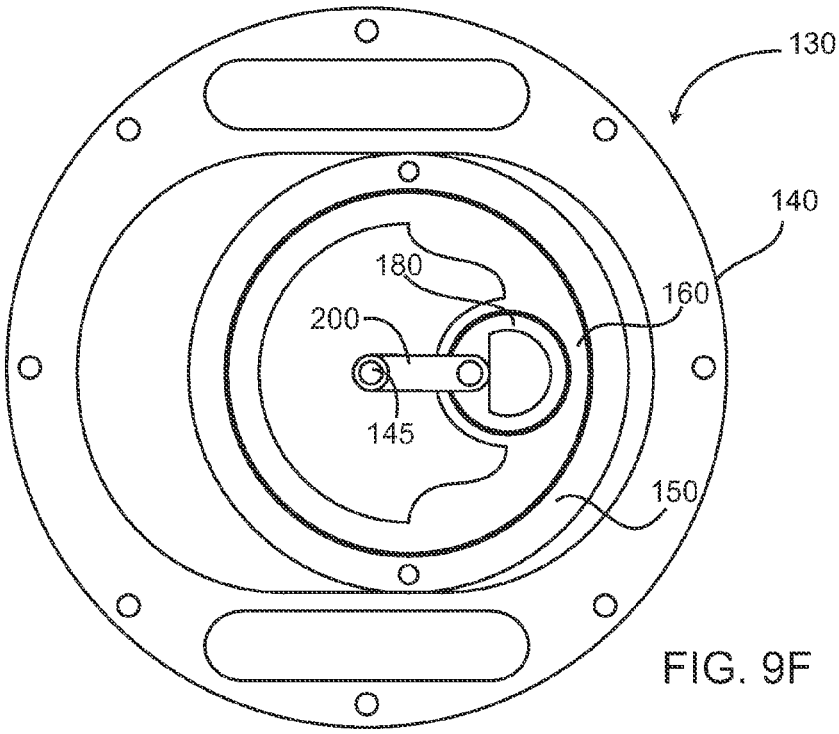
FIG. 9F is a side elevational view of the output mechanism between near the right-most position, the rotary motion output at an approximately 3:00 position.

One preferred output mechanism 130 comprises a substantially hollow enclosure 140 that captures a generally circular outer ring 150 that itself captures a substantially circular middle ring 160 (FIGS. 8-9F). The middle ring 160 has a circular opening 170 therein that is offset from the center 165 of the middle ring 160. The circular opening 170 captures an inner ring 180 that has an aperture 190 proximate to a peripheral edge 188 thereof. The aperture 190 rotationally captures a crankshaft 200 at one end 204, a second end 206 of which is rotationally fixed to a center aperture 145 of the enclosure 140. The second end 206 forms the rotary motion output 16. The linear displacement of the outer ring 150 is equal to the output crankshaft 200 offset.

Preferably the inner ring 180 has a radius $r_i$ of substantially one-half of the radius $r_m$ of the middle ring 160, such that two-cusped hypocycloid motion is achieved by the outer ring 150, namely linear reciprocal motion, as the crankshaft 200 rotates about the center aperture 145 of the enclosure 140.

Figure 7A:
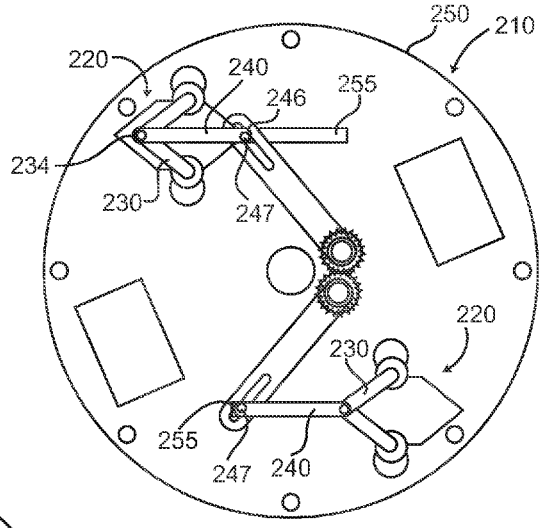
FIG. 7A is a side elevational view of the output bladder linkage, illustrating a top output bladder-engaging plunger in a non-compressed position.
Figure 7B:
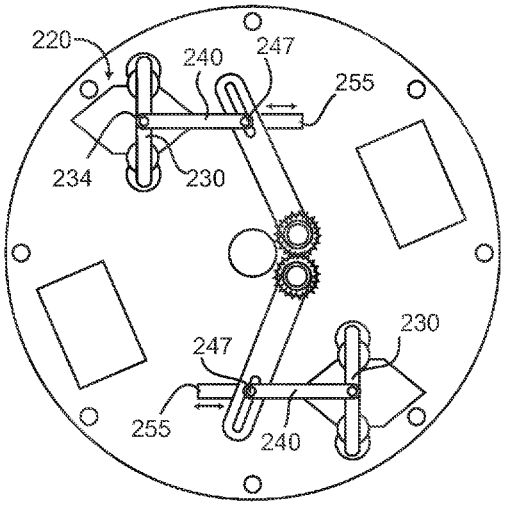
FIG. 7B is a side elevational view of the output bladder linkage, illustrating the top output bladder-engaging plunger between the non-compressed position and a compressed position.
Figure 7C:
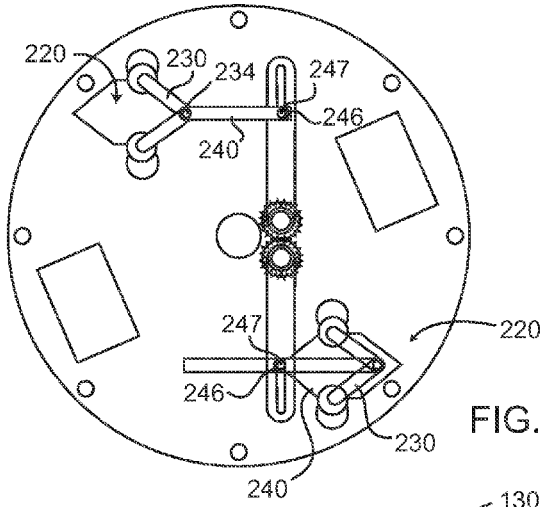
FIG. 7C is a side elevational view of the output bladder linkage, illustrating the top output bladder-engaging plunger in the compressed position.

An output bladder linkage 210 cooperates with the output bladder 110 of each hydraulic transmission means 90 for conveying synchronized reciprocal motion of each output bladder 110 to the outer ring 150 of the output mechanism 130. In one preferred embodiment, for every one rotation of the input cam 30, four cycles of reciprocal motion of the output bladder linkage 210 causes the outer ring 150 to reciprocate four times. Clearly, however, other even numbers of rollers 40 may be used with corresponding numbers of input bladders 100. Preferably the output bladder linkage 210 comprises at least one output bladder-engaging plunger 220 that includes two members 230 each pivotally joined at one end 234 thereof to a first end 244 of a lateral displacement member 20 (FIG. 7A-7C). The lateral displacement member 240 is captured within a channel 255 of an output bladder linkage enclosure 250. A second end 246 of the lateral displacement member 240 is pivotally fixed to the outer ring 150 of the output mechanism 130, preferably with a pin 247. As such, reciprocal motion of the output bladder 110 is mechanically transferred to the lateral displacement member 240, the pin 247, and to the outer ring 150 of the output mechanism 130. Preferably, exactly two output bladder-engaging plungers 220 are mechanically and cooperatively joined, out of phase, to allow one plunger 220 being forced into an expanded position to cause the other plunger 220 to compress the other output bladder 110 while driving the outer ring 150 in reciprocal motion.

In a second preferred embodiment of the output mechanism 130 (FIGS. 10-12, 13A-13D), the lateral displacement member includes a plurality of output posts 270 that each engage a loosely S-shaped elongated output block slot 285 in an output block 280. The output block 280 further includes a circular output block aperture 288 therein that rotatably receives a block ring 290 fixed to the rotary motion output 16. As such, with each output post 270 moving in synchronized linear reciprocal motion, guided by channel 300, the output block 280 is driven in orbital motion around the rotary motion output 16 and the block ring 290 rotates within the output block aperture 288 to drive the rotary motion output 16. Preferably the lateral displacement member includes exactly four of the output posts 270. Further, a bearing 295 may be included between the block ring 290 and the output block 280 to facilitate rotation of the block ring 290 within the output block 280. The linear displacement of each of the plurality of output posts 270 is equal to twice the offset of the rotary motion output 16 from the center of the block ring 290.

In use, when the rotary motion input 14 is applied to the rotary input cam 30 of the input mechanism 20, each of the at least one rollers 40 in turn depresses each linear displacement linkage 70. The plurality of arcuate linkages 60 each lift each linear displacement linkage 70 once the roller 40 has passed thereby. Each linear displacement linkage 70 actuates on of the plunger means 80 to compress one of the input bladders 100, causing the output bladders to assume a non-compressed, expanded position. Each output bladder 110 is coupled through the output bladder linkage 210 to reciprocate the outer ring 150 of the output mechanism 130 within the enclosure 140. The inner ring 180 is forced to follow an inverse hypocycloid motion with two cusps to rotate the crankshaft 200 around the center aperture 145 of the enclosure 140 to produce the rotary motion output 16.

While a particular form of the invention has been illustrated and described, it will be apparent that various modifications can be made without departing from the spirit and scope of the invention. For example, any even number of rollers 40 may be used with twice that number of input bladders 100. Various other mechanical means may be used for the output bladder linkage 210, as may be known in the art. Accordingly, it is not intended that the invention be limited, except as by the appended claims.

What is claimed is:

1. A transmission system for transmitting a rotary motion input to a rotary motion output, the system comprising:

an input mechanism comprising a rotary input cam rotationally fixed to at least one roller proximate a periphery thereof, a substantially cylindrical hub, a plurality of arcuate linkages each pivotally fixed at each end thereof to an adjacent arcuate linkage and a first end of a linear displacement linkage, each of the at least one rollers capturing at least one arcuate linkage against an inside surface of the cylindrical hub, each linear displacement linkage pivotally fixed at a second end to a plunger means;

at least one hydraulic transmission means, each hydraulic transmission means including a plurality of input bladders, each input bladder cooperating with one of the plunger means of the input mechanism, each bladder in fluid communication with an output bladder, each hydraulic transmission means substantially filled with a generally non-compressible fluid;

an output mechanism comprising a substantially hollow enclosure capturing a substantially circular outer ring that captures a substantially circular middle ring having a circular opening therein that is offset from the center thereof, the circular opening in the middle ring rotationally capturing an inner ring having an aperture proximate a peripheral edge thereof, the aperture for rotationally capturing an crankshaft at one end, a second end of the crankshaft rotationally fixed to a center aperture of the enclosure and forming the rotary motion output; and an output bladder linkage cooperating with the output bladder of each hydraulic transmission means for conveying synchronized reciprocal motion of each output bladder to the outer ring of the output mechanism;

whereby when the rotary motion input is applied to the rotary input cam of the input mechanism, each of the at least one rollers in turn depresses each linear displacement linkage, the plurality of arcuate linkages each lifting each linear displacement linkage once the roller has passed thereby, each linear displacement linkage actuating one of the plunger means to compress one of the input bladders, thereby expanding one of the output bladders thereof, each output bladder coupled through the output bladder linkage to reciprocate the outer ring of the output mechanism within the enclosure, the inner ring following inverse hypocycloid motion with two cusps to rotate the crankshaft around the center aperture of the enclosure to produce the rotary motion output.

2. The transmission system of claim 1 wherein the at least one roller is exactly four rollers, and wherein the plurality of arcuate linkages is exactly eight.

3. The transmission system of claim 1 wherein each plunger means is a pair of horizontal sliding members each pivotally fixed at one end to the second end of one of the plurality of linear displacement linkages, and wherein the cylindrical hub includes a plurality of bladder cavities for containing one of the input bladders, whereby with each pair of horizontal sliding members forced against the cylindrical hub within each bladder cavity, the input bladder is compressed.

4. The transmission system of claim 1 wherein the at least one hydraulic transmission means is exactly two, and wherein all of the input bladders in one of the hydraulic transmission means are compressed by the input mechanism substantially simultaneously, and wherein substantially simultaneously all of the input bladders in the other of the hydraulic transmission means are expanded generally simultaneously by compression of the output bladder.

5. The transmission system of claim 1 wherein each of the input bladders of each of the hydraulic transmission means are in fluid communication with the output bladder through a hydraulic conduit.

6. The transmission system of claim 5 wherein the substantially non-compressible fluid is hydraulic fluid.

7. The transmission system of claim 1 wherein each of the hydraulic transmission means are further in fluid communication with a fluid pressure adjustment means.

8. The transmission system of claim 1 wherein the inner ring has a radius of substantially one-half of that of the middle ring.

9. The transmission system of claim 1 wherein the output bladder linkage comprises at least one output bladder-engaging plunger that includes two members each pivotally joined at one end thereof to a first end of a lateral displacement member, the lateral displacement member captured within a channel of an output bladder linkage enclosure, a second end of the lateral displacement member pivotally fixed to the outer ring of the output mechanism, whereby the reciprocal motion of the output bladder is mechanically transferred to the outer ring of the output mechanism.

10. The transmission system of claim 9 wherein the output bladder linkage comprises exactly two output bladder-engaging plungers, one each for engaging the output bladder of two hydraulic transmission means.

11. The transmission system of claim 9 wherein the lateral displacement member includes a plurality of output posts that each engage an S-shaped elongated output block slot in an output block, the output block having a circular output block aperture therein that rotatably receives a block ring fixed to the rotary motion output, whereby with the output posts moving in synchronized linear reciprocal motion, the output block is driven in orbital motion around the rotary motion output, the block ring rotating within the output block aperture to drive the rotary motion output.

12. The transmission system of claim 11 wherein the number of output posts in the lateral displacement member is exactly four.

13. The transmission system of claim 1 wherein the output bladder linkage comprises at least one output bladder-engaging plunger that includes two members each pivotally joined at one end thereof to a first end of a lateral displacement member, the lateral displacement member captured within a channel of an output bladder linkage enclosure, a second end of the lateral displacement member pivotally fixed to a linkage block slidably captured within the output bladder linkage enclosure, the linkage block fixed to at least two portions of the outer ring, whereby the bladder-engaging plunger causes the linkage block and the outer ring to reciprocate back and forth with the expansion and contraction of the output bladder.

* * * * *